US006382750B1

(12) United States Patent
King

(10) Patent No.: US 6,382,750 B1
(45) Date of Patent: May 7, 2002

(54) METHOD OF OPENING A CABINET DOOR AND HARDWARE THEREFOR

(76) Inventor: Lawrence A. King, 124 S. Sager Rd., Valparaiso, Porter County, IN (US) 46383

( * ) Notice: Subject to any disclaimer, the term of this patent is extended or adjusted under 35 U.S.C. 154(b) by 0 days.

(21) Appl. No.: 09/636,197

(22) Filed: Aug. 10, 2000

Related U.S. Application Data

(60) Provisional application No. 60/149,151, filed on Aug. 16, 1999.

(51) Int. Cl.[7] ..... A47B 88/00
(52) U.S. Cl. ..... 312/319.9; 16/901
(58) Field of Search ..... 312/319.9, 139, 312/326; 16/412, 415, 901; 49/30, 307, 310, 311

(56) References Cited

U.S. PATENT DOCUMENTS

| | | | | | |
|---|---|---|---|---|---|
| 686,244 | A | * | 11/1901 | Armantrout | 49/310 |
| 842,081 | A | * | 1/1907 | Clark | 16/412 |
| 1,337,384 | A | * | 4/1920 | Allen | 16/412 |
| 1,751,107 | A | * | 3/1930 | Smith | 49/70 |
| 2,481,970 | A | | 9/1949 | Bell | |
| 2,555,783 | A | * | 6/1951 | Bryson | 16/412 X |
| 2,699,368 | A | | 1/1955 | Selmer | |
| 2,709,635 | A | | 5/1955 | Carani | |
| 2,813,771 | A | | 11/1957 | Selmer | |
| 2,934,390 | A | | 4/1960 | Wright | |
| 3,121,907 | A | * | 2/1964 | Stebbins | 16/412 |
| 3,391,674 | A | * | 7/1968 | Bruleigh | 16/901 X |
| 3,676,895 | A | * | 7/1972 | Stewart | 16/412 |
| 4,817,239 | A | * | 4/1989 | Campbell et al. | 16/901 X |
| 5,277,487 | A | | 1/1994 | Simon | |
| 5,975,662 | A | * | 11/1999 | Weber | 312/319.9 |
| 6,067,690 | A | * | 5/2000 | Herman | 16/901 X |
| 6,189,183 | B1 | * | 2/2001 | Hartselle, III | 16/412 |
| 6,328,392 | B1 | * | 12/2001 | Whitcomb | 312/319.9 |

FOREIGN PATENT DOCUMENTS

| | | | | |
|---|---|---|---|---|
| CH | 428408 | * | 5/1926 | 312/319.9 |

* cited by examiner

*Primary Examiner*—Peter M. Cuomo
*Assistant Examiner*—Hanh V. Tran
(74) *Attorney, Agent, or Firm*—Gary M. Hartman; Domenica N. S. Hartman

(57) ABSTRACT

A cabinet hardware configured for attachment to the lower end of a cabinet door, including conventional sliding and hinged doors. The hardware projects from the edge of the door to be readily accessible with the foot of a person wishing to open the door, and therefore enables the door to be opened without the use of hands. Accordingly, the hardware enables a user to open the door while his or her hands are occupied, such as when holding trash or recyclable items that are intended to be placed in a bin within the cabinet, or when the user's hands are wet or soiled with foodstuffs while trying to get a towel or additional cooking utensils or equipment.

20 Claims, 1 Drawing Sheet

METHOD OF OPENING A CABINET DOOR AND HARDWARE THEREFOR

CROSS REFERENCE TO RELATED APPLICATIONS

This application claims the benefit of U.S. Provisional Application No. 60/149,151, filed Aug. 16, 1999.

BACKGROUND OF THE INVENTION

1. Field of the Invention

The present invention generally relates to cabinet hardware.

2. Description of the Prior Art

Cabinets for kitchens and various other areas typically include a handle by which sliding and hinged (swinging) cabinet doors are opened. Prior art handles require the user to grasp and pull the handle with his or her hands. This operation can be difficult if the user's hands are full, and is undesirable if the user's hands are soiled as is often the case when cooking or trying to access a slide-out garbage or recycling bin built into a cabinet.

BRIEF SUMMARY OF THE INVENTION

According to the present invention, there is provided a cabinet hardware configured for attachment to the lower end of a cabinet door, including conventional sliding and hinged doors. The hardware projects from the edge of the door to be readily accessible with the foot of a person wishing to open the cabinet door, and therefore enables the door to be opened without the use of hands. Accordingly, the invention enables a user to open the door while his or her hands are occupied, such as when holding trash or recyclable items that are intended to be placed in a bin within the cabinet, or when the user's hands are wet or soiled with foodstuffs while trying to get a towel or additional cooking utensils or equipment. In addition to the above features, the invention saves wear on the cabinet door and the fine wood finish that is often present, and avoids soap, foodstuffs, refuse and other potentially harmful agents from coming in contact with the wood finish.

Commercially, the invention can be used by chefs and cooks for various lower cabinet doors to help keep them clean of foodstuffs that is generally on their hands during food preparation. This promotes a more sanitary kitchen by avoiding the transfer of uncooked foodstuffs on the hands of colleagues, as can easily occur with a standard cabinet pull handle. Additional commercial applications include small refrigerator doors (e.g., under a bar), lower file cabinet drawers, and cabinet doors in the medical, optometry, dentistry and veterinarian fields, where cleanliness and germs are of concern.

Other objects and advantages of this invention will be better appreciated from the following detailed description.

BRIEF DESCRIPTION OF THE DRAWINGS

The present invention will now be described, by way of example, with reference to the accompanying drawings.

DETAILED DESCRIPTION OF THE PREFERRED EMBODIMENT

Figure 1:
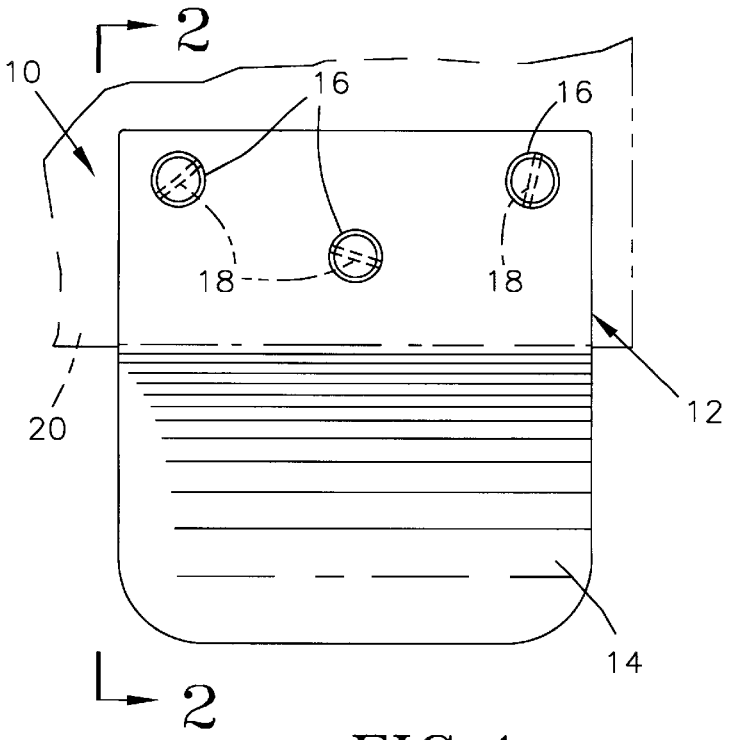
FIG. 1 is a front view of a cabinet hardware in accordance with a first embodiment of the invention.

In FIG. 1, a foot pull 10 in accordance with the first embodiment of this invention is shown as comprising a plate 12 with a lower arcuate end 14. The upper end of the plate 12 includes a number of holes 16 through which fasteners 18 are received for attaching the foot pull 10 to the lower edge of a cabinet door 20, such as a sliding or hinged (swinging) door of a kitchen cabinet. The lower edge of the plate 12 is shown as being roughly parallel to the upper end of the plate 12, and is gradually curved therebetween. The upper end of the plate 12 is planar, with a portion of the lower arcuate end 14 lying in a second plane that is offset from the plane of the upper end. As a result, the lower edge of the plate 12 projects outward from the outer surface of the door 20 by the offset as measured in a direction normal to the outer surface of the door 20. An offset of about ¾ inch is believed to be sufficient to promote access by the foot of a user, though lesser and greater offsets are foreseeable. The arcuate end 14 preferably constitutes about half the height of the plate 12 as shown to further promote the accessibility of the foot pull 10 to the user.

Figure 2:
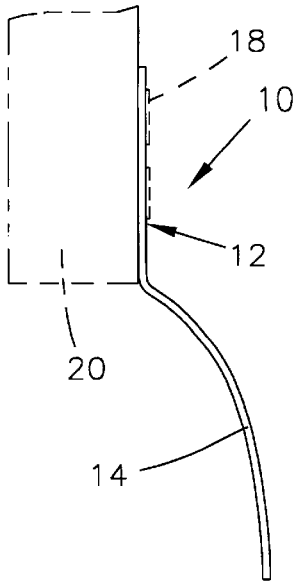
FIG. 2 is a side view of the cabinet hardware of FIG. 1 attached to the lower edge of a cabinet door.
Figure 3:
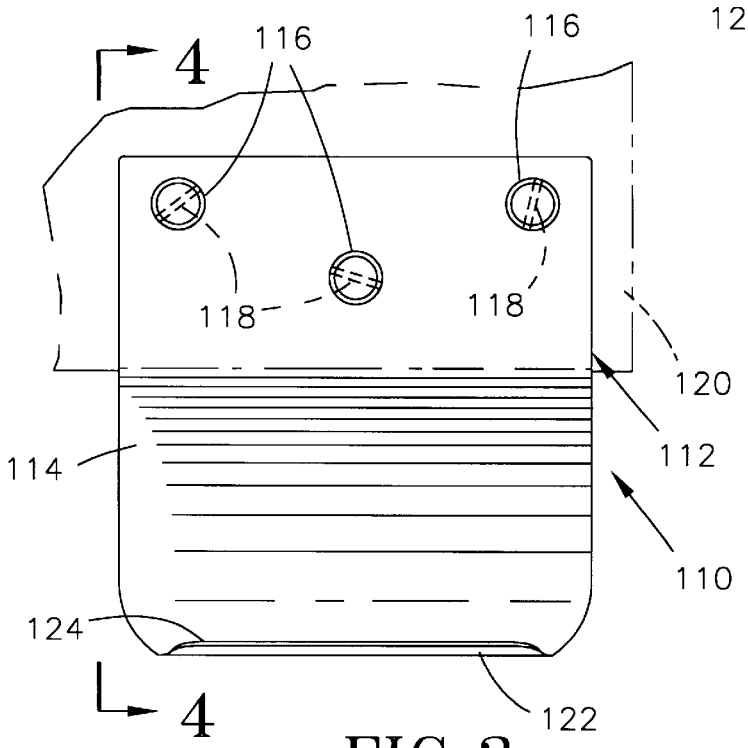
FIG. 3 is a front view of a cabinet hardware in accordance with a preferred embodiment of the invention.
Figure 4:
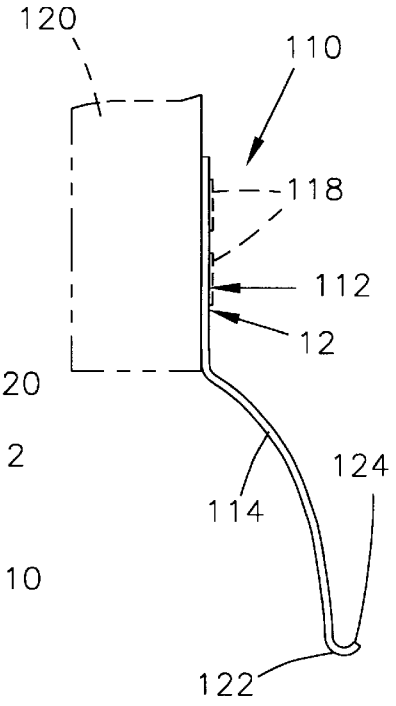
FIG. 4 is a side view of the cabinet hardware of FIG. 3 attached to the lower edge of a cabinet door.

In FIG. 2, a foot pull 110 in accordance with the preferred embodiment of this invention is shown. Similar to the foot pull 10 of FIG. 2, the preferred foot pull 110 comprises a plate 112 with a lower arcuate end 114. The upper end of the plate 112 includes a number of holes 116 through which fasteners 118 are received for attaching the foot pull 110 to the lower edge of a cabinet door 120. In contrast to the foot pull 10 of FIG. 1, the lower edge of the plate 112 is formed to have a curved lip 122 that reduces scuffing of the user's shoe on the foot pull 110, as well as facilitates use when the user is barefoot. The distal edge 124 of the lip 122 preferably faces upward to further promote this feature of the invention.

The Figures provide exemplary dimensions for the foot pulls 10 and 110, which should not be considered as limitations to the invention. The plates 12 and 112 can be formed of various materials, including metal and various structural plastics. For typical consumer applications, the plates 12 and 112 may be formed of brass, or a steel that may be provided with a primer coating to facilitate painting.

While the invention has been described in terms of certain embodiments, it is apparent that other forms could be adopted by one skilled in the art. Accordingly, it should be understood that the invention is not limited to the specific embodiments illustrated in the Figures. It should also be understood that the phraseology and terminology employed above are for the purpose of disclosing the illustrated embodiments, and do not necessarily serve as limitations to the scope of the invention. Accordingly, the scope of the invention is to be limited only by the following claims.

What is claimed is:

1. A cabinet hardware attached to a cabinet door having a vertical surface and a lower edge, the hardware being attached to the vertical surface of the door, projecting below the lower edge of the door and projecting outward from the vertical surface of the door, the hardware comprising:

a plate having an upper portion, a lower portion, and an arcuate portion therebetween, the upper portion being attached to the vertical surface of the door so as to be disposed in a first plane, the lower portion being disposed in a second plane horizontally offset from the first plane, the upper portion defining an upper edge of the plate, the lower portion defining a lower edge of the plate, the lower portion of the plate projecting below the lower edge of the door and being accessible with a foot of a person attempting to open the door by placing the foot beneath the lower portion of the plate;

a curved lip at the lower edge of the plate, the curved lip curving about a horizontal axis and in a direction away from the first plane; and means disposed at the upper portion of the plate for attaching the plate to the vertical surface of the door.

2. A cabinet hardware according to claim 1, wherein the lower edge of the plate is parallel to the upper portion of the plate.

3. A cabinet hardware according to claim 1, wherein the second plane is offset from the first plane by a distance of about ¾ inch.

4. A cabinet hardware according to claim 1, wherein the hardware has a height delimited by the upper and lower edges of the plate, the upper portion of the plate constitutes about half the height of the plate, and the lower portion and the arcuate portion combined constitute about half the height of the plate.

5. A cabinet hardware according to claim 1, wherein the curved lip has a distal edge that faces upward toward the upper edge of the plate.

6. A cabinet hardware according to claim 1, wherein the attaching means comprises a plurality of holes through the upper portion of the plate.

7. A cabinet hardware according to claim 1, wherein the attaching means comprises a plurality of fasteners.

8. A cabinet hardware according to claim 1, wherein substantially all of the lower and arcuate portions of the plate project below the lower edge of the door.

9. A cabinet hardware according to claim 1, wherein the hardware is formed of metal or plastic.

10. A cabinet hardware according to claim 1, wherein the hardware is formed of metal and is coated with a paint primer.

11. A cabinet door comprising:

a vertical surface having a lower edge at a lowermost end of the door; and a cabinet hardware attached to the vertical surface, projecting below the lower edge of the vertical surface, and projecting away from the vertical surface of the door, the hardware comprising a plate having an upper portion, a lower portion, and an arcuate portion therebetween, the upper portion being attached to the vertical surface of the door so as to be disposed in a first plane, the lower portion being disposed in a second plane approximately parallel to the first plane and horizontally offset from the first plane, the upper portion defining an upper edge of the plate, the lower portion defining a lower edge of the plate, the hardware having a height delimited by the upper and lower edges of the plate, the upper portion of the plate constituting about half the height of the plate, the lower portion and the arcuate portion combined constituting about half the height of the plate;

a curved lip at the lower edge of the plate, the curved lip curving about a horizontal axis and in a direction away from the first plane, the curved lip having a distal edge that faces upward;

a plurality of holes in the upper portion of the plate; and fasteners disposed in the holes and attaching the plate to the door;

wherein the upper portion of the plate is parallel to and contacts the vertical surface of the door, the lower portion of the plate projects below the lower edge of the door, and the lower portion of the plate is accessible with a foot of a person attempting to open the door by placing the foot beneath the lower portion of the plate.

12. A cabinet door according to claim 11, wherein substantially all of the lower and arcuate portions of the plate project below the lowermost end of the door.

13. A method of opening a cabinet door having a vertical surface and a lower edge, the method comprising the steps of:

attaching a cabinet hardware to the vertical surface of the door so that the hardware projects below the lower edge of the door and projects outward from the vertical surface of the door, the hardware comprising:

a plate having an upper portion, a lower portion, and an arcuate portion therebetween, the upper portion being attached to the vertical surface of the door so as to be disposed in a first plane and the lower portion being disposed in a second plane horizontally offset from the first plane, the upper portion defining an upper edge of the plate, the lower portion defining a lower edge of the plate, the lower portion of the plate projecting below the lower edge of the door and being accessible with a foot of a person attempting to open the door by placing the foot beneath the lower portion of the plate;

a curved lip at the lower edge of the plate, the curved lip curving about a horizontal axis and in a direction away from the first plane; and means disposed at the upper portion of the plate for attaching the plate to the vertical surface of the door;

placing the foot beneath the lower portion of the plate; and then contacting the curved lip with the foot and pulling at the lower portion of the plate with the foot to open the door.

14. A method according to claim 13, further comprising the step of forming the cabinet hardware so that the lower edge of the plate is parallel to the upper portion of the plate.

15. A method according to claim 13, further comprising the step of forming the cabinet hardware so that the second plane is offset from the first plane by a distance of about ¾ inch, so that the lower portion of the plate projects about ¾ inch from an outer surface of the door in a direction normal to the outer surface.

16. A method according to claim 13, further comprising the step of forming the cabinet hardware so that the hardware has a height delimited by the upper and lower edges of the plate, the upper portion of the plate constitutes about half the height of the plate, the lower portion and the arcuate portion combined constitute about half the height of the plate, and at least the lower portion and the arcuate portion project below the lower edge of the door.

17. A method according to claim 13, further comprising the step of forming the cabinet hardware so that the curved lip has a distal edge that faces upward following the attaching step.

18. A method according to claim 13, wherein the attaching step entails attaching the hardware to the vertical surface of the door so that substantially all of the lower and arcuate portions of the plate project below the lower edge of the door.

19. A method according to claim 13, wherein the hardware is formed of metal and is coated with a paint primer.

20. A method according to claim 19, further comprising the step of painting the hardware prior to attaching the hardware to the door.

* * * * *